United States Patent [19]

Yourd, III et al.

[11] Patent Number: 4,537,848

[45] Date of Patent: Aug. 27, 1985

[54] POSITIVELY CHARGED TONER COMPOSITIONS CONTAINING PHOSPHONIUM CHARGE ENHANCING ADDITIVES

[75] Inventors: Raymond A. Yourd, III; Debesh Majumdar, both of Rochester; Robert J. Gruber, Pittsford, all of N.Y.

[73] Assignee: Xerox Corporation, Stamford, Conn.

[21] Appl. No.: 621,977

[22] Filed: Jun. 18, 1984

[51] Int. Cl.[3] ..... G03G 9/12

[52] U.S. Cl. ..... 430/110

[58] Field of Search ..... 430/110

[56] References Cited

U.S. PATENT DOCUMENTS 3,804,764 4/1974 Strella et al. ..... 252/62.1
4,299,903 11/1981 Au Clair et al. ..... 430/137
4,378,419 3/1983 Ciccarelli ..... 430/110

FOREIGN PATENT DOCUMENTS 57-210345 12/1982 Japan .

*Primary Examiner*—John D. Welsh

[57] ABSTRACT

Disclosed are improved positively charged toner composition comprised of resin particles, pigment particles, and as a charge enhancing additive a phosphonium compound of the formula:

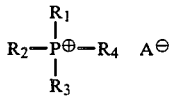

I.

wherein $R_1$, $R_2$, $R_3$, and $R_4$, are selected from the group consisting of alkyl, aryl, substituted alkyl, and substituted aryl, and A is an anion.

35 Claims, No Drawings

POSITIVELY CHARGED TONER COMPOSITIONS CONTAINING PHOSPHONIUM CHARGE ENHANCING ADDITIVES

BACKGROUND OF THE INVENTION

This invention is generally directed to toner and developer compositions, and more specifically, the present invention is directed to toner compositions, including magnetic toner compositions, containing therein certain charge enhancing additives, which impart a positive charge to the toner resin particles. Developer compositions containing the phosphonium charge enhancing additives of the present invention are useful for causing the development of electrostatic latent images, including color images. Additionally the positively charged toner compositions containing the phosphonium additives of the present invention are particularly useful in electrostatographic imaging systems having incorporated therein a Viton coated fuser roll, since many of these additives do not react substantially with Viton, causing undesirable decomposition thereof, thereby adversely affecting image quality.

Developer compositions with charge enhancing additives, especially additives which impart a positive charge to the toner resin particles are well-known, reference for example U.S. Pat. Nos. 3,893,935, 3,944,493, 4,007,293, 4,079,014 and 4,394,430. Thus for example there is described, in U.S. Pat. No. 3,893,935 the use of certain quaternary ammonium salt as charge control agents for electrostatic toner compositions. In accordance with the disclosure of this patent, certain quaternary ammonium salts when incorporated into a toner material provided a composition which exhibited relatively high uniform stable net toner charge when mixed with a suitable carrier vehicle; and this toner also exhibited a minimum amount of toner throw off. Further there is disclosed in U.S. Pat. No. 4,338,390 developer and toner compositions having incorporated therein as charge enhancing additives organic sulfate and sulfonate compositions. A similar disclosure is contained in U.S. Pat. No. 4,394,430.

There is also described in U.S. Pat. No. 2,986,521, reversal developer compositions comprised of toner resin particles coated with finely divided colloidal silica. According to the disclosure of this patent the development of electrostatic latent images on negatively charged surfaces is accomplished by applying a developer composition having a positively charged triboelectric relationship with respect to the colloidal silica. Moreover there is disclosed in U.S. Pat. No. 4,298,672 positively charged toner compositions containing resin particles, and pigment particles, and as a charge enhancing additive alkyl pyridinium compounds and their hydrates of the formula as detailed in Column 3, beginning at line 14. Examples of alkyl pyridinium compounds disclosed include cetyl pyridinium chloride. While the developer compositions disclosed in the 672 patent are sufficient for their intended purposes it appears that the alkyl pyridinium compounds involved react with the polymer contained on Viton fuser rolls causing decomposition thereof. Also several of the other charge control agents disclosed in the prior art interact with certain fuser rolls, such as Viton fuser rolls, used in electrostatographic systems. This interaction causes the fuser to be adversely affected, resulting in deterioration of the image quality. For example, Viton fuser rolls may discolor and turn black, develop multiple surface cracks and harden, when certain charge control additive compounds are contained in the toner mixture.

One Viton fuser roll selected for use in electrostatographic copying machines, is comprised of a soft roll fabricated from lead oxide, and duPont Viton E-430 resin, a vinylidene fluoride hexafluoropropylene copolymer. This roll contains approximately 15 parts of lead oxide, and 100 parts of Viton E-430, which mixture is blended and cured on the roll substrate at elevated temperatures. Apparently the function of the lead oxide is to generate unsaturation by dehydrofluorination for crosslinking, and to provide release mechanisms for the toner composition. Excellent image quality has been obtained with Viton fuser rolls, however, in some instances there results a toner fuser compatibility problem when charge control agents are part of the toner mixture. For example, it appears that certain specific charge control additives, such as quaternary ammonium compounds, and alkyl pyridinium compounds, including cetyl pyridinium chloride, react with the Viton of these rolls. Thus cetyl pyridinium chloride when part of the toner mixture appears to be catalytically decomposed by the lead oxide contained in the fuser roll, resulting in a highly unsaturated compound, which polymerizes and condenses with the unsaturated Viton E-430 material. In view of this, the Viton fuser roll turns black, develops multiple surface cracks, and the surface thereof hardens, thereby causing deterioration in image quality.

Toner compositions having incorporated therein many of the above described charge enhancing additives are useful for causing the development of images formed on layered photoresponsive imaging devices comprised of a photogenerating layer in contact with a transport layer. These devices usually are charged negatively, rather than positively as is the situation with selenium photoreceptors, thereby requiring a toner composition that is positively charged in order that the toner particles may be suitably attracted to the electrostatic latent image contained on the photoreceptor surface. In view of this efforts have been devoted to obtaining developer compositions containing toner resins which are positively charged. Thus while many charge control additives are known, there continues to be a need for new additives. Specifically there continues to be a need for additives which will not interact with Viton type fuser rolls. Additionally, there continues to be a need for charge control additives which are thermally stable at high temperatures. Moreover, there continues to be a need for positively charged toner and developer compositions which are humidity insensitive since it is known that moisture contained in the atmosphere, or moisture from other sources, can adversely effect the electrical properties of the toner compositions involved.

Also the prior art charge enhancing additives are based on nitrogen containing compounds, while in contrast the charge enhancing additives of the present invention are derivable from phosphorus containing compounds, and therefore represent a new class of additives. These additives can be economically prepared in addition to the other favorable physical chemical characteristics possessed thereby as indicated herein. Also the additives of the present invention are substantial nontoxic, and they can be easily and permanently dispersed in toner resin particles. Moreover toner and developer compositions containing the phosphonium additives of the present invention provide compositions having desirable admix charging.

SUMMARY OF THE INVENTION

It is an object of the present invention to provide toner and developer compositions containing phosphonium charge enhancing additives, which overcome many of the above-noted disadvantages.

In another object of the present invention there is provided positively charged toner compositions which are useful for causing the development of electrostatic latent images, including magnetic images, and color images.

In yet another object of the present invention there is provided positively charged toner compositions containing as charge enhancing additives phosphonium compositions.

A further object of the present invention is to provide charge enhancing additives some of which such as the tetraflouroborate salt are thermally stable at high temperatures.

Another object of the present invention resides in the provision of phosphonium charge enhancing additives which do not interact and/or attack Viton rubber selected for use in imaging systems containing certain fusing roll systems.

In another object of the present invention there is provided a developer composition containing positively charged toner particles, carrier particles and phosphonium charge enhancing additives.

In further object of the present invention there are provided magnetic toner compositions, and color toner compositions containing positively charged toner particles, pigment compositions, carrier particles, and phosphonium charge enhancing additives.

In yet a further object of the present invention there are provided positively charged toner compositions which are water insensitive and have desirable admix properties.

These and other objects of the present invention are accomplished by providing developer compositions, and toner compositions, wherein the dry electrostatic toner compositions are comprised of resin particles, pigment particles, and phosphonium charge enhancing additive salts of the following formula:

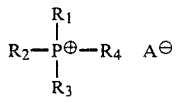

I.

wherein $R_1$, $R_2$, $R_3$, $R_4$, are independently selected from the group consisting of alkyl, aryl, substituted alkyl, and substituted aryl, and A represents a suitable anion.

In one specific embodiment of the present invention there is provided electrostatic toner compositions comprised of resin particles, pigment particles, and phosphonium charge enhancing additive salts selected from the group consisting of triphenylbutylphosphonium bromide, and triphenylbutylphosphonium tetrafluoroborate of the following formula:

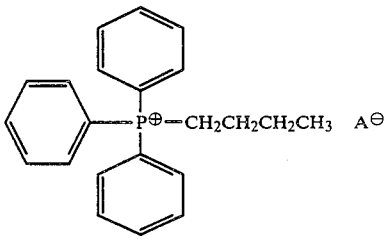

II.

wherein A is the anion bromide or tetrafluoroborate.

Illustrative examples of alkyl substituents include those of from 1 carbon atom to about 20 carbon atoms, and preferably from 1 carbon atom to about 10 carbon atoms, such as methyl, propyl, ethyl, butyl, pentyl, decyl, pentadecyl, eiocyl, and the like. Aryl substituents envisioned include those of from about 6 carbon atoms to about 24 carbon atoms, such as phenyl, anthryl, and the like. The R groups may also be substituted with other radicals, including for example alkyl, aryl, halogen, and the like providing the objectives of the present invention are achieved. Moreover the R substituents can be comprised of groups such as benzyl, tolyl, and other similar radicals.

Illustrative examples of substituents selected for the anion A include halogens, methylsulfate, tosylate, tetrafluoroborate, and the like within bromide and tetrafluoroborate being preferred.

Examples of specific charge enhancing additives included with the scope of the present invention, and encompassed by the above formulas are triphenylbutylphosphonium bromide, triphenylbutylphosphonium tetrafluoroborate, tetrabutylphosphonium bromide, tetraethylphosphonium bromide, triphenylbenzylphosphonium bromide, triphenylbenzylphosphonium tetrafluoroborate, triphenylbenzylphosphonium chloride, triphenyldodecylphosphonium bromide, and the like.

The phosphonium charge enhancing additives of the present invention can be prepared by various known methods, reference for example the general procedure described in the Journal of the American Chemical Society, 1960, Volume 82, pages 3919 to 3924, the disclosure of which is totally incorporated herein by reference, including the reaction of an appropriate tertiary phosphine with effective alkylating agents, such as alkyl halides, aryl halides, dimethylsulfate, ethyl p-toluenesulfonate, and the like. More specifically the phosphonium halide additives can be prepared by reacting with an excess of an alkyl halide a trialkyl phosphine dissolved in a suitable solvent. The reaction mixture is refluxed, followed by separation of the resulting phosphonium halide products, by filtration for the insoluble materials, and precipitation for the halides that are soluble in the reaction solvent. These products were identified by infrared spectroscopy, melting point data, and elemental analysis.

Examples of phosphine reactants include triethylphosphine, tributylphosphine, and the like, while suitable alkyl halides, and aryl halides that can be selected are 1-bromobutane, 1-bromohexadecane, 1-chlorohexadecane, 1-chlorobutane, benzyl chloride, benzyl bromide, and other similar substances. Various suitable effective solvents can be used for the reaction, including ethanol, 1-butanol, toluene, and benzene.

The phosphonium tetrafluoroborates additives can be prepared by reacting the corresponding phosphonium halides with an alkali metal tetrafluoroborate. More specifically an aqueous solution mixture of phosphonium halide is reacted with an excess of an aqueous solution of sodium tetrafluoroborate, resulting in a precipitate of the phosphonium tetrafluoroborate product. The products obtained were identified by infrared spectroscopy, melting point data, and elemental analysis. Examples of reactant phosphonium halides selected include tetrabutylphosphonium bromide, tetrabutylphosphonium chloride, triphenylbutylphosphonium halides, such as triphenylbutylphosphonium chloride, triphenylbenzylphosphonium chloride, triphenylbenzylphosphonium bromide, tributyldecylphosphonium bromide, and other similar compounds.

Illustrative examples of suitable toner resins selected for the toner and developer compositions of the present invention include polyamides, epoxies, polyurethanes, vinyl resins and polymeric esterification products of a dicarboxylic acid and a diol comprising a diphenol. Any suitable vinyl resin may be selected for the toner of the present application including homopolymers or copolymers of two or more vinyl monomers. Typical of such vinyl monomeric units include: styrene, p-chlorostyrene vinyl naphthalene unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, vinyl butyrate and the like; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate, and the like; acrylonitrile, methacrylonitrile, acrylamide, vinyl ethers, such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; diolefins such as styrene butadiene copolymers, and other similar materials.

As one preferred toner resin there can be selected the esterification products of a dicarboxylic acid and a diol comprising a diphenol. These materials are illustrated in U.S. Pat. No. 3,590,000, the disclosure of which is totally incorporated herein by reference. Other preferred toner resins include styrene/methacrylate copolymers, and styrene/butadiene copolymers, polyester resins obtained from the reaction of bis-phenol A and propylene oxide, followed by the reaction of the resulting product with fumaric acid, and branched polyester resins resulting from the reaction of dimethylterephthalate, 1,3-butanediol, 1,2-propanediol, and pentaerythritol.

The resin particles are present in a sufficient, but effective amount, thus when 5 percent by weight of the phosphonium charge enhancing additives disclosed herein are present, and 10 percent by weight of pigment, or colorant such as carbon black is contained therein, about 85 percent by weight of resin material is selected. Generally from about 0.1 weight percent to about 20 weight percent and preferably from about 1 weight percent to about 5 weight percent, of the phosphonium additive is selected for mixing with the toner particles, however the charge enhancing additive of the present invention may be used in various other amounts providing the objectives of the present invention are accomplished. The phosphonium charge enhancing additive of the present invention can be blended into the toner composition, or coated on the pigment particles, such as carbon black, which are used as the colorants in the developer composition. When used as a coating, the charge enhancing additive of the present invention is present in an amount of from about 0.1 weight percent to about 5 weight percent and preferably in an amount of from about 0.3 weight percent to about 1 weight percent.

Numerous well known suitable pigments or dyes can be selected as the colorant for the toner particles including for example, carbon black, nigrosine dye, aniline blue, magnetities and mixtures thereof. The pigment, which is preferably carbon black, should be present in a sufficient amount to render the toner composition highly colored in order that it will cause the formation of a clearly visible image on a suitable recording member. Generally, the pigment particles are present in amounts of from about 3 percent by weight to about 20 percent by weight, based on the total weight of the toner composition, however, lesser or greater amounts of pigment particles can be selected providing the objectives of the present invention are achieved.

When the pigment particles are comprised of magnetites, that is a mixture of iron oxides ($FeO.Fe_2O_3$) including those commercially available as Mapico Black, they are present in the toner composition in an amount of from about 10 percent by weight to about 70 percent by weight, and preferably in an amount of from about 20 percent by weight to about 50 percent by weight. Toner compositions containing these pigments are referred to as magnetic toner compositions.

Also embraced within the scope of the present invention are colored toner compositions with toner resin particles, carrier particles, the phosphonium charge enhancing additives illustrated herein, and as pigments or colorants, magenta, cyan, and/or yellow particles, as well as mixtures thereof. More specifically, with regard to the production of color images utilizing a developer composition containing the charge enhancing additives of the present invention, illustrative examples of magenta materials that may be selected as pigments, include for example, 2,9-dimethyl-substituted quinacridone and anthraquinone dye identified in the color index as Cl 60710, Cl Dispersed Red 15, a diazo dye identified in the color index as Cl 26050, Cl Solvent Red 19, and the like. Illustrative examples of cyan materials that may be used as pigments include copper tetra-4(octadecyl sulfonamido) phthalocyanine, X-copper phthalocyanine pigment listed in the color index as Cl 74160, Cl Pigment Blue, and Anthrathrene Blue, identified in the color index as Cl 69810, Special Blue X-2137, and the like; while illustrative examples of yellow pigments that may be selected include diarylide yellow 3,3-dichlorobenzidene acetoacetanilides, a monoazo pigment identified in the color index as Cl 12700, Cl Solvent Yellow 16, a nitrophenyl amine sulfonamide identified in the color index as Foron yellow SE/GLN, Cl dispersed yellow 33, 2,5-dimethoxy-4-sulfonanilide phenylazo-4'-chloro-2,5-dimethoxy aceto-acetanilide, permanent yellow FGL, and other similar compositions.

These pigments namely, cyan, magenta, and yellow when used with the charge enhancing additives of the present invention are generally present in the toner composition an amount of from about 2 weight percent to about 15 weight percent based on the weight of the toner resin particles.

Illustrative examples of carrier particles that can be selected for mixing with the toner compositions of the present invention include those substances that are capable of triboelectrically obtaining a charge of opposite polarity to that of the toner particles. Accordingly, the carrier particles of the present invention are selected so as to be of a negative polarity enabling the toner particles which are positively charged to adhere to and surround the carrier particles. Specific examples of carrier particles are granular zircon, granular silicon, methyl methacrylate, glass, steel, nickel, iron ferrites, silicon dioxide, and the like. Additionally, there can be selected as carrier particles nickel berry carriers comprised of nodular carrier beads of nickel, characterized by surfaces of reoccurring recesses and protrusions thereby providing particles with a relatively large external area, reference U.S. Pat. No. 3,847,604, the disclosure of which is totally incorporated herein by reference.

The selected carrier particles can be used with or without a coating, the coating generally containing fluoropolymers, such as polyvinylidenefluoride resins, terpolymers of styrene, methylmethacrylate, and a silane, such as triethoxy silane, tetrafluoroethylenes, other known coatings and the like.

The diameter of the carrier particles can vary, generally however the diameter is from about 50 microns to about 1,000 microns, allowing these substances to possess sufficient density and inertia to avoid adherance to the electrostatic images during the development process. The carrier particles can be mixed with the toner composition in various suitable effective combinations, including for example about 1 part per toner to about 10 parts to about 200 parts by weight of carrier.

The toner composition of the present invention can be prepared by a number of known methods, including melt blending the toner resin particles, pigment particles or colorants, and the phosphonium charge enhancing additives, followed by mechanical attrition. Other methods include those well known in the art such as spray drying, melt dispersion, extrusion, dispersion polymerization, and suspension polymerization. In one dispersion polymerization method, a solvent dispersion of the resin particles, the pigment particles, and the phosphonium charge enhancing additive are spray dried under controlled conditions resulting in the desired product. Toner compositions prepared in this manner result in a positively charged toner composition in relation to the carrier materials selected, and these materials exhibit the improved properties as mentioned hereinbefore.

The toner and developer compositions of the present invention may be selected for use in developing images in electrostatographic imaging systems, containing therein photoreceptors that are capable of being charged negatively. This usually occurs with organic photoreceptors, illustrative examples of which include layered photoresponsive devices comprised of transport layers and photogenerating layers, reference U.S. Pat. No. 4,265,990, the disclosure of which is totally incorporated herein by reference, and other similar layered photoresponsive devices. Examples of photogenerating layers include trigonal selenium, metal phthalocyanines, metal free phthalocyanines and vanadyl phthalocyanines, while examples of charge transport layers include the diamines as disclosed in the '990 Patent. Other useful photoresponsive devices may include polyvinylcarbazole 4-dimethylaminobenzylidene, benzhydrazide; 2-benzylidene-aminocarbazole, 4-dimethylamino-benzylidene, (2-nitro-benzylidene)-p-bromoaniline; 2,3-diphenyl-quinazoline; 1,2,4-triazine; 1,5-diphenyl-3-methyl pyrazoline 2-(4'-dimethyl-amino phenyl)-benzoaxzole; 3-aminocarbazole, polyvinyl carbazole-trinitrofluorenone charge transfer complex; and mixtures thereof.

The charge in femtocoulombs per micron for the toner composition of the present invention can vary depending on the amount of charge enhancing additive present. Generally however this charge is from about to 0.75 to about 2.0, and preferably from about 1.0 to about 1.5 femtocoulombs per micron when the additive is present in an amount of from 0.1 percent by weight to about 20 percent by weight.

The following examples are being supplied to further define various species of the present invention, it being noted that these examples are intended to illustrate and not limit the scope of the present invention. Parts and percentages are by weight unless otherwise indicated.

EXAMPLE I

There was prepared the phosphonium charge enhancing additive triphenylbutyl phosphonium bromide by dissolving 20 grams of triphenylphosphine, in 250 milliliters of 1-butanol. Thereafter 10.52 grams, 1 percent molar excess, of 1-bromobutane was added to the reaction mixture followed by refluxing at a temperature of 118 degrees centigrade, for 24 hours. The excess 1-butanol solvent was removed on a rotary evaporator, and there resulted a white crystalline product of triphenylbutyl phosphonium bromide. This product was dissolved in a minimal amount of 1-butanol, and precipitated in 600 milliliters of cold ethyl ether, followed by filtration, washing with ethyl ether, and drying overnight under a vacuum.

The resulting product was identified by elemental analysis, infrared spectroscopy, and melting point determinations.

Calculated For Triphenylbutyl phosphonium bromide: Theory: C, 66.17, H, 6.06, P, 7.76 Found: C, 66.16, H, 6.15, P, 7.66 Melting Point: 239° to 241° C.

EXAMPLE II

The phosphoniumtetrafluoroborate salts can be obtained from phosphonium halides, or phosphonium methylsulfate salts by dissolving the corresponding phosphonium halides, or phosphonium methylsulfates in water. Subsequent to the addition of sodium tetrafluoroborate to the resulting aqueous solution the corresponding tetrafluoroborate salt precipitates, and is isolated from the solution by filtration. More specifically triphenylbutylphosphonium tetrafluoroborate can be prepared from the triphenylbutylphosphonium bromide obtained in Example I in the following manner:

There was dissolved in 300 milliliters of a 2:1 water:acetone solution 15.0 grams of triphenylbutylphosphonium bromide. Thereafter 4.54 grams of sodium tetrafluoroborate was dissolved in 150 milliliters of water, and the resulting solution was added slowly to the phosphonium salt solution. A white precipitate product formed, which was filtered from the reaction mixture, washed with water, and dried under a vacuum overnight.

The product triphenylbutylphosphonium tetrafluoroborate was identifed by elemental analysis, infrared spectroscopy, and melting point determinations.

Calculated For triphenylbutylphosphonium tetrafluoroborate: Theory: C,65.06 H,5.95 P,7.62 Found: C,65.05, H,6.01, P,7.65

EXAMPLE III

There was prepared a toner composition by melt blending at a temperature of 100° C., followed by mechanical attrition, 2 percent by weight of triphenylbutylphosphonium bromide, prepared in accordance with Example I, 6 percent by weight of REGAL 330$^R$ carbon black, and 92 percent by weight of a styrene butadiene resin, 89 percent by weight of styrene, and 11 percent by weight of butadiene, commercially available from Goodyear Chemical Company as Pliolite. The resulting toner was classified in order to remove particles smaller than 5 microns in diameter.

The triboelectric charge of 1.65 femtocoulombs per micron on the above-prepared toner composition was measured against a Hoeganese steel carrier coated with 0.20 percent by weight of Kynar 301, a polyvinylidene fluoride resin commercially available from Pennwalt Company, at 3 percent toner concentration, such triboelectric measurements being accomplished on a toner charge spectrograph. This instrument dispenses toner particles in proportion to the charge to diameter ratio and with the aid of automated microscopy can generate charge distribution histograms for selected toner size classes.

When an uncharged toner composition containing 92 percent by weight of the Pliolite resin, 6 percent by weight of carbon black, and 2 percent by weight of the triphenylbutylphosphonium bromide, was mixed with a charged toner composition with 2 percent by weight of triphenylbutylphosphonium bromide, 6 percent by weight of REGAL 330$^R$ carbon black, and 92 percent by weight of the Pliolite styrene butadiene resin, 89 percent by weight of styrene, and 11 percent by weight of butadiene, the admix charging rate for the uncharged toner composition was less than 30 seconds.

The above experiments were repeated for the purpose of determining the charge admix properties of a toner composition that did not contain the phosphonium charge enhancing additive. There was thus prepared by melt blending followed by mechanical attrition a toner composition, comprised of 94 percent by weight of a styrene butadiene resin, 89 percent by weight of styrene, and 11 percent by weight of butadiene, commercially available as Pliolite, and 6 percent by weight of REGAL 330$^R$ carbon black. This composition had a charge thereon of 0.6 femtocoulombs per micron, against a Hoeganese steel carrier coated with 0.20 percent by weight of Kynar 301, a polyvinylidene fluoride resin commercially available from Pennwalt Company, at 3 percent toner concentration, such triboelectric measurements being accomplished on a toner charge spectrograph, and an admix charging rate of greater than 8 minutes.

Additionally, toner compositions prepared as described above, with the exception that they contained triphenylbutylphosphonium tetrafluoroborate as the charge enhancing additive were humidity insensitive in that the initial tribocharge was only reduced from 1.00 femtocoulombs per micron at ambient conditions, to 0.76 femtocoulombs per micron, at 80° F., and 80 percent relative humidity, while toner compositions containing cetyl pyridinium chloride were humidity sensitive in that the charge was reduced from 1.8 femtocoulombs at ambient conditions, to 1.1 femtocoulombs at 80° F., and 80 percent relative humidity. Similarly the above-prepared toner composition containing the charge enhancing additive triphenylbutylphosphonium bromide was humidity insensitive in that the initial tribocharge was only reduced from 1.65 femtocoulombs per micron at ambient conditions, to 1.12 femtocoulombs per micron, at 80° F., and 80 percent relative humidity, The humidity sensitivity measurements were accomplished by the following procedure: The toner compositions involved, were placed in a humidity chamber maintained at a temperature of 80° F., and at a relative humidity of 80 percent. These conditions were maintained for 24 hours. The charge on the toner composition were then compared to the results at ambient laboratory conditions.

EXAMPLE IV

A Viton fuser roll test was also accomplished by inserting a strip of Viton approximately 1/8" thick, a length of $\frac{3}{4}$" and a width of $\frac{1}{2}$", in separate charge enhancing additives contained in a test tube with 50 percent thereof of the charge enhancing additive to be tested. The test tube was then heated to 200° C. for a period of 24 hours and the Viton fuser strip was removed. After removal and drying, the Viton fuser strip was examined visually for discoloration, surface cracks and a determination was made as to whether the surface thereof hardened by for example, using a durometer, which measures indentation hardness. With the tetrafluoroborate charge enhancing additive as prepared in Example II, no discoloration, or surface cracks were visually observed, and the surface of the Viton did not harden, while with cetyl pyrdinium chloride discoloration, and surface cracks were visually observable.

Other modifications of the present invention may occur to those skilled in the art based upon a reading of the present disclosure and these modifications are intended to be included within the scope of the present invention.

We claim:

1. An improved positively charged toner composition comprised of resin particles, pigment particles, and as a charge enhancing additive in an amount of from about 0.1 percent by weight to about 20 percent by weight a phosphonium compound of the formula:

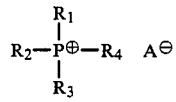

I.

wherein $R_1$, $R_2$, $R_3$, and $R_4$, are independently selected from the group consisting of alkyl, aryl, substituted alkyl, and substituted aryl, and A is an anion.

2. A composition in accordance with claim 1 wherein $R_1$, $R_2$, $R_3$, and $R_4$, are alkyl substituents of from 1 carbon atom to about 20 carbon atoms.

3. A composition in accordance with claim 1 wherein the alkyl substituents are methyl, or ethyl.

4. A composition in accordance with claim 1 wherein the aryl substituents contain from about 6 to about 24 carbon atoms.

5. A composition in accordance with claim 1 wherein the aryl substituents are phenyl.

6. A composition in accordance with claim 1 wherein the aryl substituents are benzyl, or tolyl.

7. A composition in accordance with claim 1 wherein $R_1$, $R_2$, and $R_3$, are phenyl, and $R_4$ is alkyl.

8. A composition in accordance with claim 1 wherein the toner resin particles are selected from the group consisting of styrene based polymers, and polyesters.

9. A composition in accordance with claim 1 wherein the resin particles are selected from the group consisting of a styrene butadiene copolymer, a polyester, and a styrene n-butyl methacrylate copolymer.

10. An improved positively charged toner composition comprised of resin particles, pigment particles, and as a charge enhancing additive in an amount of from about 0.1 percent by weight to about 20 percent by weight a phosphonium compound selected from the group consisting of triphenylbutylphosphonium bromide and triphenylbutylphosphonium tetrafluoroborate.

11. A composition in accordance with claim 10 wherein the phosphonium charge enhancing additive is present in an amount of from about 0.1 percent by weight to about 20 percent by weight.

12. A composition in accordance with claim 10 wherein the phosphonium charge enhancing additive is present in an amount of from about 1 percent by weight to about 5 percent by weight.

13. A composition in accordance with claim 10 wherein the toner resin particles are polyesters, or styrene based polymers.

14. A composition in accordance with claim 13 wherein the styrene based polymers are styrene methacrylate, styrene acrylate, or styrene butadiene.

15. A composition in accordance with claim 1 wherein the pigment particles are comprised of carbon black.

16. A composition in accordance with claim 10 wherein the resin particles are present in an amount of from 70 percent by weight to about 90 percent by weight, the pigment particles are present in an amount of from about 5 percent by weight to about 20 percent by weight, and the phosphonium charge enhancing additive is present in an amount of from 0.1 percent by weight to about 10 percent by weight.

17. A developer composition comprised of the positively charged toner composition of claim 1, and carrier particles.

18. A developer composition in accordance with claim 17 wherein the carrier particles are comprised of steel, coated with a polymeric resin.

19. A developer composition in accordance with claim 17 wherein the resin particles are selected from a group consisting of styrene methacrylate resins, styrene acrylate resins, styrene butadiene resins and polyester resins.

20. A developer composition in accordance with claim 17 wherein the pigment particles are carbon black, or magnetite.

21. A method of imaging which comprises forming a negative electrostatic latent image on a photoresponsive imaging member, contacting the resulting image with the toner composition of claim 1, followed by subsequently transferring the developed image to a suitable substrate, and optionally permanently affixing the image thereto.

22. A method of imaging in accordance with claim 21 wherein fixing is accomplished with a fuser roll containing lead oxide and a vinylidene fluoride hexafluoropropylene copolymer.

23. A method of imaging in accordance with claim 21 wherein the photoresponsive member is comprised of a substrate, a photogenerating layer, and a charge transport layer.

24. A method of imaging in accordance with claim 23 wherein the photogenerating layer is trigonal selenium or vanadyl phthalocyanine, dispersed in a resinous binder, and the charge transport layer is comprised of N,N'-diphenyl-N,N'-bis(3-methylphenyl)1,1'-biphenyl-4,4'-diamine dispersed in a polycarbonate resinous binder.

25. A method of imaging in accordance with claim 21 wherein the resin particles are comprised of a styrene n-butyl methacrylate copolymer, a polyester, or a styrene butadiene copolymer.

26. A method of imaging in accordance with claim 21 wherein the charge enhancing additive is a phosphonium compound selected from the group consisting of triphenylbutylphosphonium bromide, and triphenylbutylphosphonium tetrafluoroborate.

27. An improved toner composition in accordance with claim 1 wherein the pigment particles are selected from magenta, cyan, and yellow pigments.

28. An improved toner composition in accordance with claim 1 wherein the pigment particles are selected from magnetites, thereby resulting in a magnetic toner composition.

29. An improved toner composition in accordance with claim 1, wherein the anion is selected from the group consisting of halogens, alkylsulfates, and tetrafluoroborates.

30. An improved toner composition in accordance with claim 17, wherein the anion is selected from the group consisting of halogens, alkylsulfates, and tetrafluoroborates.

31. An improved developer composition in accordance with claim 17, wherein the charge enhancing additive is a phosphonium compound selected from the group consisting of triphenylbutylphosphonium bromide, and triphenylbutylphosphonium tetrafluoroborate.

32. An improved positively charged toner composition consisting essentially of resin particles present in an amount of from about 70 percent by weight to about 90 percent by weight, pigment particles present in an amount of from about 5 percent by weight to about 20 percent by weight, and as a charge enhancing additive present in an amount of from about 0.1 percent by weight to about 20 percent by weight a phosphonium compound of the formula:

$$R_2-\overset{\overset{R_1}{|}}{\underset{\underset{R_3}{|}}{P}}{}^{\oplus}-R_4 \quad A^{\ominus} \qquad \text{I.}$$

wherein $R_1$, $R_2$, $R_3$ and $R_4$ are independently selected from the group consisting of alkyl, aryl, substituted alkyl and substituted aryl, and A is an anion.

33. A toner composition in accordance with claim 32 wherein the anion is selected from the group consisting of halogens, alkyl sulfates, and tetrafluoroborates.

34. A toner composition in accordance with claim 32 wherein the charge enhancing additive is a phosphonium compound selected from the group consisting of triphenylbutylphosphonium bromide, and triphenylbutylphosphonium tetrafluoroborate.

35. A developer composition in accordance with claim 17 wherein the charge enhancing additive is a phosphonium compound selected from the group consisting of triphenylbutylphosphonium bromide, and triphenylbutylphosphonium tetrafluoroborate.

* * * * *